United States Patent [19]

Kissick

[11] Patent Number: 4,846,333

[45] Date of Patent: Jul. 11, 1989

[54] COIN CADDY ATTACHMENT FOR VENDING MACHINE

[76] Inventor: Lloyd P. Kissick, 1985 E. 5th St., #5, Tempe, Ariz. 85281

[21] Appl. No.: 118,165

[22] Filed: Nov. 9, 1987

[51] Int. Cl.[4] ..... G07F 1/04

[52] U.S. Cl. ..... 194/344; 194/350; 206/806; 220/18; 232/1 D; 211/88; 248/359 G

[58] Field of Search ..... 194/344, 350, 353, 342, 194/343; 453/63; 206/0.8, 806; 220/18; 232/1 R, 1 D, 12, 4 R; 211/13, 73, 88, 126; 248/174, 359 G, 459

[56] References Cited

U.S. PATENT DOCUMENTS

| | | | |
|---|---|---|---|
| 814,276 | 3/1906 | Combs | 194/343 X |
| 1,626,366 | 4/1927 | Sughrua | 232/4 R |
| 1,684,124 | 9/1928 | Burgess | 248/459 |
| 2,051,131 | 8/1936 | Crow | 206/0.8 |
| 2,482,258 | 9/1949 | Funk, Jr. et al. | 206/0.8 |
| 2,631,735 | 3/1953 | Levesque | 211/88 |
| 2,726,757 | 12/1955 | Kellstrom | 206/0.8 X |
| 2,726,835 | 12/1955 | Hummel | 248/459 |
| 3,187,923 | 6/1965 | Christensen | 220/18 |
| 3,194,249 | 7/1965 | Lonke et al. | 194/343 X |
| 3,209,883 | 10/1965 | Hopps | 221/24 X |
| 3,586,279 | 6/1971 | Benson | 248/759 X |
| 4,165,802 | 8/1979 | Mathews | 194/344 |
| 4,462,414 | 7/1984 | Gordon | 194/344 X |
| 4,535,921 | 8/1985 | Sanders | 220/18 X |

*Primary Examiner*—Joseph J. Rolla
*Assistant Examiner*—Edward S. Ammeen
*Attorney, Agent, or Firm*—Tod R. Nissle

[57] ABSTRACT

An attachment for a vending machine. The vending machine includes a chute for inserting coins in the machine and includes a lever or button for actuating the machine to dispense an item after the coin has been inserted in the coin chute. The attachment includes a coin receptacle and an attachment member attached to the receptacle. The attachment member engages the coin chute and maintains the attachment in fixed position on the vending machine.

5 Claims, 1 Drawing Sheet

COIN CADDY ATTACHMENT FOR VENDING MACHINE

This invention relates to a method and apparatus for facilitating the transport of coin and the use of coin in a vending machine.

More particularly, the invention relates to a coin caddy for use on a vending machine which includes a chute for inserting coins into the machine and includes manually operable actuating means for operating the machine after coin is inserted in the coin chute, the coin caddy enabling a user to rapidly transfer coins from the caddy to the chute with one hand while utilizing the other hand to operate the actuating means of the machine.

In a further respect, the invention relates to a promotional system which tends to increase consumer use of the vending machines owned by a business concern.

Vending machines are widely utilized to dispense foodstuffs, articles of clothing, prizes, coin (in the case of slot machines), and various other items to the public. As is well known, such machines are operated by inserting coin into a coin receiving slot or chute in the machine and then manually depressing or pulling the appropriate button or lever to actuate the machine and cause it to dispense a selected item. A vending machine can require the insertion of a substantial number of coins before the machine will dispense a selected item. This is the case when low donomination coins such as nickels are being utilized or when slot machines and like machines are utilized. Carrying many coins is, because of the weight and bulk of coins, awkward, as is readily demonstrated when an individual attempts to carry a substantial amount of change in his or her pocket. The change is bulky, noisy, heavy and uncomfortable. Further, attempting to extract the change from a pocket or other container is also awkward and usually requires the use of both hands. One hand is used to hold the pocket or other change container in place while the other hand extracts the change. After the change is removed from the container it must be sorted, or at least positioned in the hand for insertion into the machine. Vending machine owners recognize that any method of facilitating the transport of coin and of facilitating the use of coin in a vending machine will ordinarily increase the convenience of using vending machines and therefore increase the use of such machines and increase the owner's profit. Vending machine owners, therefore, have long been interested in and searched for methods and apparatus which facilitate the transport coin and use of coin in vending machines.

Accordingly, it would be highly desirable to provide an improved method and apparatus for simplifying the transport of coin and facilitating the insertion of coin into vending machines.

Therefore, it is a principal object of the invention to provide an improved method and apparatus for transporting a plurality of coins and for utilizing such coin in a vending machine.

A further object of the invention is to provide improved coin carrying and transport apparatus which requires that an individual utilize only a single hand while removing coins and inserting them in a vending machine, the apparatus therefore leaving one of the user's hands free to operate the controls of the vending machine, to consume food or beverage, etc.

Another object of the instant invention is to provide an improved system for promoting the use of coin in a vending machine, the system tending to increase the use of coin in a vending machine by facilitating transport of coin and use of coin in a vending machine, and tending to increase such use of coin by utilizing apparatus which the owner of a vending machine can acquire at minimal cost.

These and other, further and more specific objects and advantages of the invention will be apparent to those skilled in the art from the following detailed description thereof, taken in conjunction with the drawings, in which.

Figures 1, 2, 3, 4:
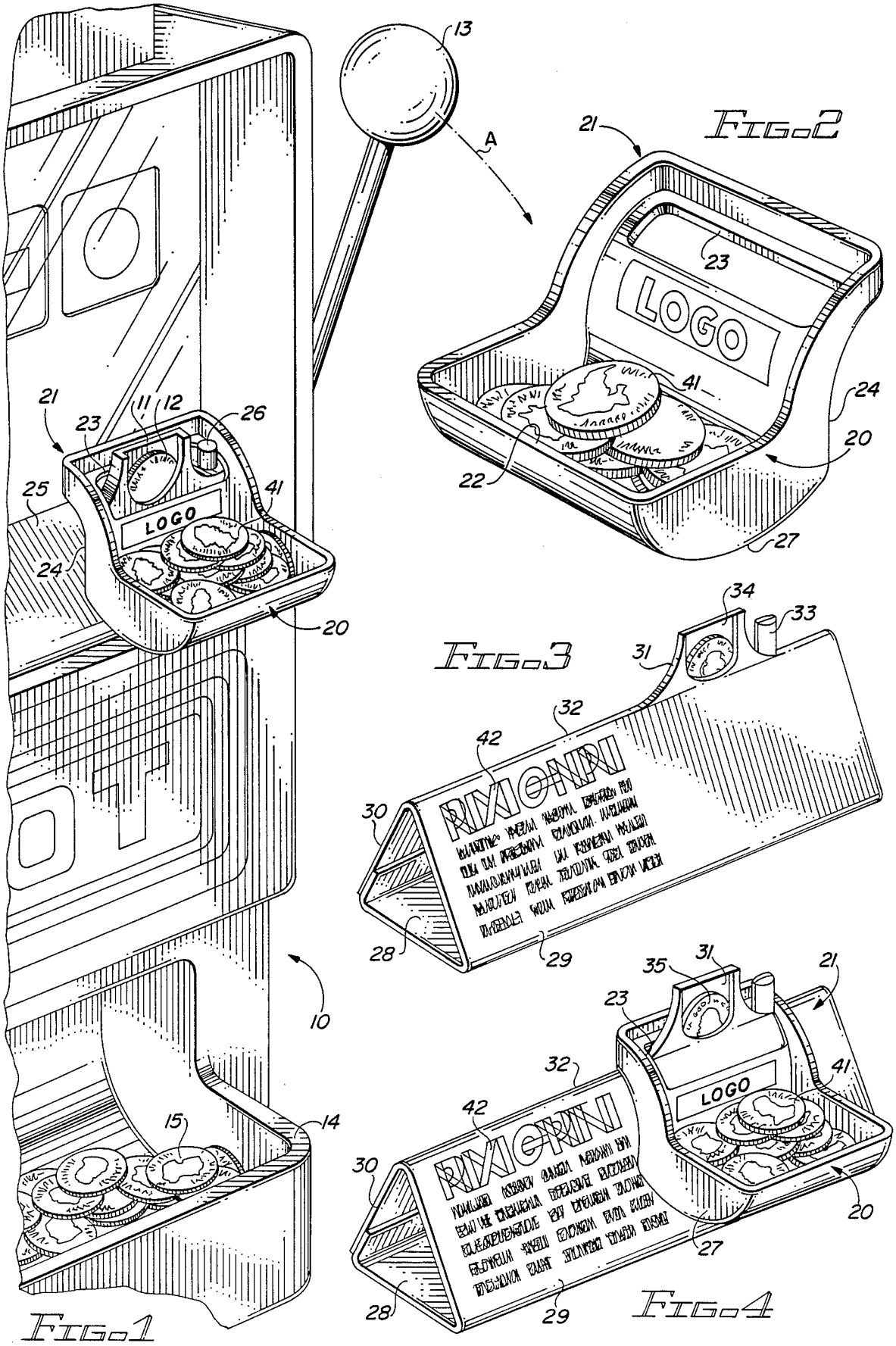
FIG. 1 is a front perspective view of a vending machine equipped with coin transport apparatus constructed in accordance with the principles of the invention.
FIG. 2 is a perspective view of the coin transport apparatus of FIG. 1.
FIG. 3 is a perspective view of a free standing promotional unit constructed in accordance with the coin transport system of the invention; and, FIG. 4 is a perspective view illustrating the coin transport apparatus of FIG. 2 in use in conjunction with the promotional unit of FIG. 3.

Briefly, in accordance with my invention, I provide an attachment for a coin activated vending machine, the vending machine typically being comprised of a chute for inserting coin into the vending machine, of manually operable actuating means for operating the machine after coin is inserted in the coin chute, of storage means in the frame for storing items to be dispensed during operation of the machine, and of means operatively associated with the actuating means and the storage means to selectively dispense at least one of the items when the actuating means is manually operated a selected number of times. The attachment permits the operation of the actuating means with one hand immediately after the other hand is utilized to insert coin in the chute and comprises an upwardly opening coin receptacle adjacent the coin chute when the tray is attached to the machine; and, attachment means connected to the coin receptacle and normally engaging the coin chute to maintain the attachment in fixed position on the machine and permit coin carried in the tray to be manually removed from the receptacle and placed in the chute with one hand while the other hand operates the actuating means.

In another embodiment of my invention I provide a method for transporting coin and quickly loading the coin into a vending machine. The vending machine includes a chute formed in the housing for inserting coin into the vending machine; manually operable actuating means for operating the machine after coin is inserted in the chute; storage means for storing items to be dispensed during operation of the machine; and, means operatively associated with the actuating means and the storage means to selectively dispense at least one of the items when the actuating means is manually operated a selected number of times. The method comprises the steps of loading coin into a coin caddy; manually grasping and carrying the coin caddy to the vending machine; placing the coin caddy on the machine with the attachment means removably engaging the chute; and, removing coin from the caddy with one hand and inserting the coin in the chute while utilizing the other hand to operate the actuating means. The caddy includes a coin receptacle and attachment means connected to the coin receptacle and shaped and dimensioned to removably engage the machine to maintain the coin caddy in fixed position on the vending machine to permit coin carried in the receptacle to be manually removed from the receptacle and placed in the coin chute with one hand while the other hand operates the actuating means.

In still another embodiment of my invention, I provide an improved system for facilitating and promoting the transport of coin and the use of coin in a vending machine, the machine including a chute for inserting coin into the vending machine, manually operable actuating means for operating the machine after coin is inserted in the chute, means for storing items to be dispensed during operation of the machine, and means operatively associated with the actuating means and the storage means to selectively dispense at least one of the items when the actuating means is manually operated a selected number of times. The improved system includes a free standing coin caddy mountable on the vending machine and a free standing promotional display for a table top. The caddy includes an upwardly opening coin receptacle adjacent the coin chute when the caddy is on the vending machine, and includes attachment means connected to the coin receptacle to removably engage the coin chute to maintain the caddy in fixed position on the machine and permit coin carried in the tray to be manually removed from the caddy and placed in the chute with one hand while the other hand operates the actuating means. The attachment means includes a chute engaging slot formed therethrough. The promotional display includes inscriptions formed thereon to explain the use of the coin caddy; and, a simulation of at least a portion of the coin chute extending upwardly from the base and through the slot formed in the attachment means when the free standing caddy is placed on the table top adjacent the promotional display.

Turning now to the drawings, which depict the presently preferred embodiment of the invention for the purpose of illustrating the practice thereof and not by way of limitation of the scope of the invention, and in which corresponding reference characters represent like elements throughout the several views, FIG. 1 illustrates a vending machine, generally indicated by reference character 10, including a coin chute 11 with a coin 12 which has just been placed in chute 11 and is downwardly slidably falling into machine 10. After coin 12 falls into the machine 10, lever 13 is forwardly manually pulled in the direction of arrow A to operate the machine. Means (not visible) are provided in machine 10 to store items to be dispensed by the machine into receptacle 14 at the bottom of the vending machine. In addition, means (not visible) are included in machine 10 and are operatively associated with actuating lever 13 and the storage means to selectively dispense at least one of the items stored in the machine when the actuating lever 13 is manually operated in the direction of arrow A a selected number of times. If the vending machine in FIG. 1 is a slot machine, then coins 15 representing a winning amount are, as is well known, only dispensed after lever 13 has been pulled in the direction of arrow A at least one time. In most cases, the lever 13 must be pulled in the direction of arrow A many times before coins 15 are dispensed by machine 10. Lever 13 can only be pulled in the direction of arrow A after the appropriate coin has been inserted in chute 11.

If the machine in FIG. 1 is a soft drink dispensing machine, then once the proper coin has been inserted in chute 11 and lever 13 manually actuated, a can of soft drink is dispensed into receptacle 14. If machine 10 is a modern soft drink machine, the machine is, instead of being equipped with actuating lever 13, probably equipped with a plurality of selector push buttons, one of which is depressed to cause a can or bottle of soft drink to be dispensed. Vending machines which dispense candy bars, gum, Kleenex tissue and a wide variety of other items are well known in the art. Such machines each include a coin chute 11, a manually operable actuating means like lever 13 or a push button, means for storing items to be dispensed during operation of the machine, and means operatively associated with the actuating means and the storage means to selectively dispense at lease one of the items when the actuating means is manually operated a selected number of times. There are many U. S. patents and other publications explaining the internal functioning of such machines.

The vending machine attachment, or coin caddy, of the invention is illustrated in FIG. 2 and generally illustrated by reference character 20. Coin caddy 20 includes upwardly opening receptacle 20 for holding and transporting coin 41. The bottom inner surface of receptacle 20 is covered by coin 41 and is not visible in FIG. 2, but said bottom inner surface is preferably a smooth curved surface which enables an individual to readily continuously smoothly slide coin along the bottom surface to lip 22. It is not preferred to make the bottom inner surface of receptacle 20 flat and perpendicular to a side wall of receptacle 20; such a construction makes it difficult to readily removed coin from the bottom of receptacle 20 with a single hand.

Attachment means 21 is connected to receptacle 20 and includes a slot 23 formed therethrough. When, as shown in FIG. 1, slot 23 is placed over chute 11, slot 23 engages and bears against the back of chute 11 and the coin caddy is fixedly maintained in place on machine 10. The upper back portion 24 of attachment means 21 is concave to enable slot 23 to fit over chute 11 and to enable the upper back portion 24 to conform to the convex surface 25 of machine 10. Portion 24 can be shaped as desired to conform to machine 10. In FIG. 1, slot 23 is also shaped and dimensioned to simultaneously fit over and circumscribe chute 11 and coin return button 26. In FIG. 2, the bottom surface 27 of the coin caddy is flat or is otherwise shaped and dimensioned such that the coin caddy will free stand on a table top in the manner shown in FIG. 2.

The free standing triangular folded cardboard promotional display of FIG. 3 includes base 28 and upright rectangular side faces 29 and 30. Inscriptions 42 printed or otherwise formed on face 29 explain how to utilize the coin caddy of FIG. 2, and explain the advantages of such use. Cardboard panel 31 is attached to and extends upwardly from the juncture 32 of sides 29 and 30, as does panel 33. The periphery of panel 31 is shaped to simulate the periphery of chute 11. The periphery of panel 33 is shaped to simulate the periphery of coin return button 26. A drawing, printed or otherwise formed on face 34 of panel 31, simulates the appearance of chute 11, including a coin 35 sliding downwardly into chute 11.

FIG. 4 illustrates the normal position of the free standing coin caddy of FIG. 2 with respect to the free standing promotional display of FIG. 3. Panel 31 projects upwardly through slot 23, simulating the manner in which the coin caddy is mounted on a vending machine 10. In FIG. 4 the promotional display and coin caddy are each resting on a table top (not shown), and both the promotional display and coin caddy are free standing.

Having described my invention in such terms as to enable those skilled in the art to understand and practice it, and having identified the presently preferred embodiments thereof,

I claim:

1. In combination with a coin activated vending machine, said machine including an upwardly projecting chute for inserting coin into said vending machine, and having a face with an upstanding coin inlet opening to receive said coin and having a back, manually operable actuating means for operating said machine after coin is inserted in said coin chute, means for storing items to be dispensed during operation of said machine, means operatively associated with said actuating means and said storage means to selectively dispense at least one of said items when said actuating means is manually operated a selected number of times, an attachment permitting the operation of said actuating means with one hand immediately after the other hand is utilized to insert coin in said chute and comprising (a) an upwardly opening coin receptacle beneath said coin chute when said attachment is mounted on said machine; and, (b) attachment means connected to and extending upwardly and rearwardly from said coin receptacle and including chute-engaging slot means formed therethrough and normally removably engaging and extending at least partially around said coin chute to maintain said receptacle in fixed position beneath said chute on said machine and permit coin carried in said receptacle to be manually upwardly removed from said receptacle and placed in said chute with one hand while the other hand operates said actuating means, said slot means including a first edge and a second edge spaced upwardly and rearwardly from said first edge when said attachment is mounted on said machine, said second edge extending across and engaging and bearing against at least a portion of said back of said chute, and said first edge extending across at least a portion of said face beneath said opening to leave said opening visible to a user and free to receive coin from the user's fingers, said attachment being removed from said machine by upwardly lifting said attachment to move said slot means upwardly over and off of said coin chute.

2. A method for transporting coin and quickly loading the coin into a vending machine, said method comprising the steps of (a) loading coin into a coin caddy to be mounted on said vending machine, said vending machine having a housing and including (i) an upwardly projecting chute formed in said housing for inserting coin into said vending machine, and having a face with an upstanding coin inlet opening to receive said coin and having a back, (ii) manually operable actuating means for operating said machine after coin is inserted in said chute, (iii) means for storing items to be dispensed during operation of said machine, and (iv) means operatively associated with said actuating means and said storage means to selectively dispense at least one of said items when said actuating means is manually operated a selected number of times, said caddy including (i) a coin receptacle, and (ii) attachment means connected to and extending upwardly and rearwardly from said coin receptacle and including chute-engaging slot means formed therethrough and normally removably engaging and extending at least partially around said coin chute to maintain said receptacle in fixed position beneath said chute on said machine and permit coin carried in said receptacle to be manually upwardly removed from said receptacle and placed in said chute with one hand while the other hand operates said actuating means, said slot means including a first edge and second edge spaced rearwardly from said first edge when said coin caddy is mounted on said machine, said second edge extending across and engaging and bearing against at least a portion of said back of said chute, and said first edge extending across at least a portion of said face beneath said opening to leave said opening visible to a user and free to receive coin from the user's fingers, said coin caddy being removed from said machine by upwardly lifting said coin caddy to move said slot means upwardly over and off of said coin chute;

(b) manually grasping and carrying said coin caddy to said vending machine;

(c) placing said coin caddy on said machine with said attachment means removably engaging said chute; and, (d) removing coin from said caddy with one hand and inserting the coin in said chute while utilizing the other hand to operate said actuating means.

3. A system for facilitating and promoting the transport of coin and the use of coin in a vending machine, said system including (a) a free standing coin caddy for said vending machine, said machine including a chute for inserting coin into said vending machine, manually operable actuating means for operating said machine after coin is inserted in said chute, means for storing items to be dispensed during operation of said machine, means operatively associated with said actuating means and said storage means to selectively dispense at least one of said items when said actuating means is manually operated a selected number of times, said caddy including (i) an upwardly opening coin receptacle adjacent said coin chute when said caddy is on said vending machine, (ii) attachment means connected to said coin receptacle to removably engage said coin chute to maintain said caddy in fixed position on said machine and permit coin carried in said receptacle to be manually removed from said receptacle and placed in said chute with one hand while the other hand operates said actuating means, said attachment means including a chute-engaging slot formed therethrough; and, (b) a free standing promotional display for a table top, said display including (i) a base, (ii) inscriptions formed thereon to explain the use of said coin caddy; and, (iii) a simulation of at least a portion of said coin chute extending upwardly from said display base and through said slot formed in said attachment means when said free standing caddy is placed on said table top adjacent said promotional display.

4. The combination of claim 1 wherein said coin receptacle includes a bottom for supporting a plurality of coins visibly loosely spread over said bottom to be manually grasped and removed from said receptacle for insertion in said chute.

5. The method of claim 2 wherein said coin receptacle includes a bottom for supporting a plurality of coins visibly loosely spread over said bottom to be manually grasped and moved from said receptacle for insertion in said chute.

* * * * *